US009962599B2

(12) United States Patent
Costello

(10) Patent No.: US 9,962,599 B2
(45) Date of Patent: May 8, 2018

(54) CUE GAME

(71) Applicant: John F. Costello, San Diego, CA (US)

(72) Inventor: John F. Costello, San Diego, CA (US)

( * ) Notice: Subject to any disclaimer, the term of this patent is extended or adjusted under 35 U.S.C. 154(b) by 0 days. days.

(21) Appl. No.: 14/583,599

(22) Filed: Dec. 27, 2014

(65) Prior Publication Data

US 2016/0184692 A1 Jun. 30, 2016

(51) Int. Cl.

| | |
|---|---|
| ***A63D 15/00*** | (2006.01) |
| ***A63F 9/24*** | (2006.01) |
| ***G06F 17/00*** | (2006.01) |
| ***G06F 19/00*** | (2011.01) |

(52) U.S. Cl.
CPC ..... *A63D 15/00* (2013.01)

(58) Field of Classification Search
CPC ... A63F 3/00; A63F 7/06; A63D 15/00; A47B 23/00; A47B 23/04
USPC ..... 473/1; 273/280, 309; 5/607; 108/6
See application file for complete search history.

(56) References Cited

U.S. PATENT DOCUMENTS

| | | | | |
|---|---|---|---|---|
| 4,077,333 | A * | 3/1978 | Ballas | A47B 23/046 108/6 |
| 5,640,729 | A * | 6/1997 | Marino | 5/607 |
| 6,347,797 | B1 * | 2/2002 | Tsai | A63D 15/04 273/309 |
| 2005/0077678 | A1 * | 4/2005 | Bibi | A63F 3/00895 273/284 |
| 2014/0077456 | A1 * | 3/2014 | Bazarko | 273/280 |

* cited by examiner

*Primary Examiner* — Gene Kim
*Assistant Examiner* — Christopher Glenn
(74) *Attorney, Agent, or Firm* — Thomas J. Tighe, Esq.

(57) ABSTRACT

An elongated playing surface includes: a long axis, a rigid planar cue section at one end, at an opposite end a rigid planar object section rotatable about the long axis, and a mid section twistable about the long axis interconnecting the cue and object sections. The game is played with a cue ball, object balls and cue stick. End and side rails confine the balls atop the playing surface. One end rail, affixed to the object section, defines one or more openings at which are disposed respective ball pockets. The object of the game is to drive the object balls into a pocket by striking them with the cue ball driven by the cue stick. From time to time a mechanism tilts the object section and twists the mid section laterally about the long axis causing balls on said sections to roll according to gravity, making them moving targets.

17 Claims, 4 Drawing Sheets

CUE GAME

FIELD OF THE INVENTION

This invention relates to cue games in which, for example, a cue ball is driven by a cue stick to strike an object ball toward a ball pocket, games such as pool, billiards, snooker, and the like that are played on a table. More particularly, this invention provides a pool table that includes unique challenges akin to skeet shooting caused by a table surface that is not entirely stationary in a single plane. This invention also provides a pool table that can be implemented in smaller, narrower sizes relative to conventional pool tables, allowing its use in smaller spaces.

BACKGROUND OF THE INVENTION

Pool type games are games of skill that require players to strike or push a cue ball, commonly all white, with a cue stick toward an object ball, commonly colored with stripes or spots, in order to propel the latter to a desired destination on the playing surface. The desired destination may be a table pocket or it may be another object ball to propel the latter to a pocket or another object ball. Ultimately the usual goal of a pool player is to sink all his or her object balls into table pockets before the other player sinks his or hers.

Conventionally pool type games are played on level steady playing surfaces usually covered by cloth to ensure that balls set in motion travel true to their intended trajectories. Such tables typically have rails with cloth-covered, elastic bumpers, commonly called cushions, for bank shots. On conventional tables a successful player needs a certain set of skills. For example, a player needs to know how to precisely set an aiming line, how to determine a precise carom angle for a bank shot, and how to impart the correct amount of back spin on the cue ball.

This invention adds a whole new set of required skills, and thus presents a novel, fun and challenging addition to the world of cue games.

SUMMARY OF THE INVENTION

This invention presents a novel table for playing a cue game in which, for example, a cue ball is driven by a cue stick to strike an object ball toward a ball pocket. The table includes a generally horizontally disposed elongated playing surface having three sections: a rigid planar cue section at one end of the playing surface, a rigid planar object section at an opposite end of the playing surface, the object section being rotatable about a long axis of the playing surface, and a mid section intermediate the cue and object sections, the mid section being twistable about the long axis. The table further includes a marginal cushioned rail for confining the balls atop the playing surface, a ball pocket disposed at an opening defined by a rail opposite the cue section, and a drive mechanism for tilting, from time to time, the object section laterally about the long axis relative to the cue section. Although the illustrated embodiment shows only one pocket, this invention can alternatively include more than one pocket. The drive mechanism preferably operates to periodically and symmetrically tilt the object section laterally to one side and then to the opposite side about the long axis, the extent of the tilting being over an angular range. The periodic tilting causes any balls on the object section to roll back and forth across the front of the pocket or pockets, thus making it more challenging to drive balls into a pocket by a cue ball propelled by a cue stick from the stationary cue section. Skills akin to skeeting shooting must be learned. The period of the symmetrical tilting is preferably three to six hertz but can be set to a lower or higher frequency to make sinking balls easier or more difficult, respectively. Alternatively the period can be user adjustable. In the preferred embodiment the angular range of object section tilting is a function of the drive mechanism linkage and is adjustable. Regardless of the relative dispositions of the cue and object sections and the twisting of the mid section, the playing surface is seamless to a rolling ball in that it is smooth and continuous throughout.

DETAILED DESCRIPTION OF THE PREFERRED EMBODIMENTS

Figure 1:
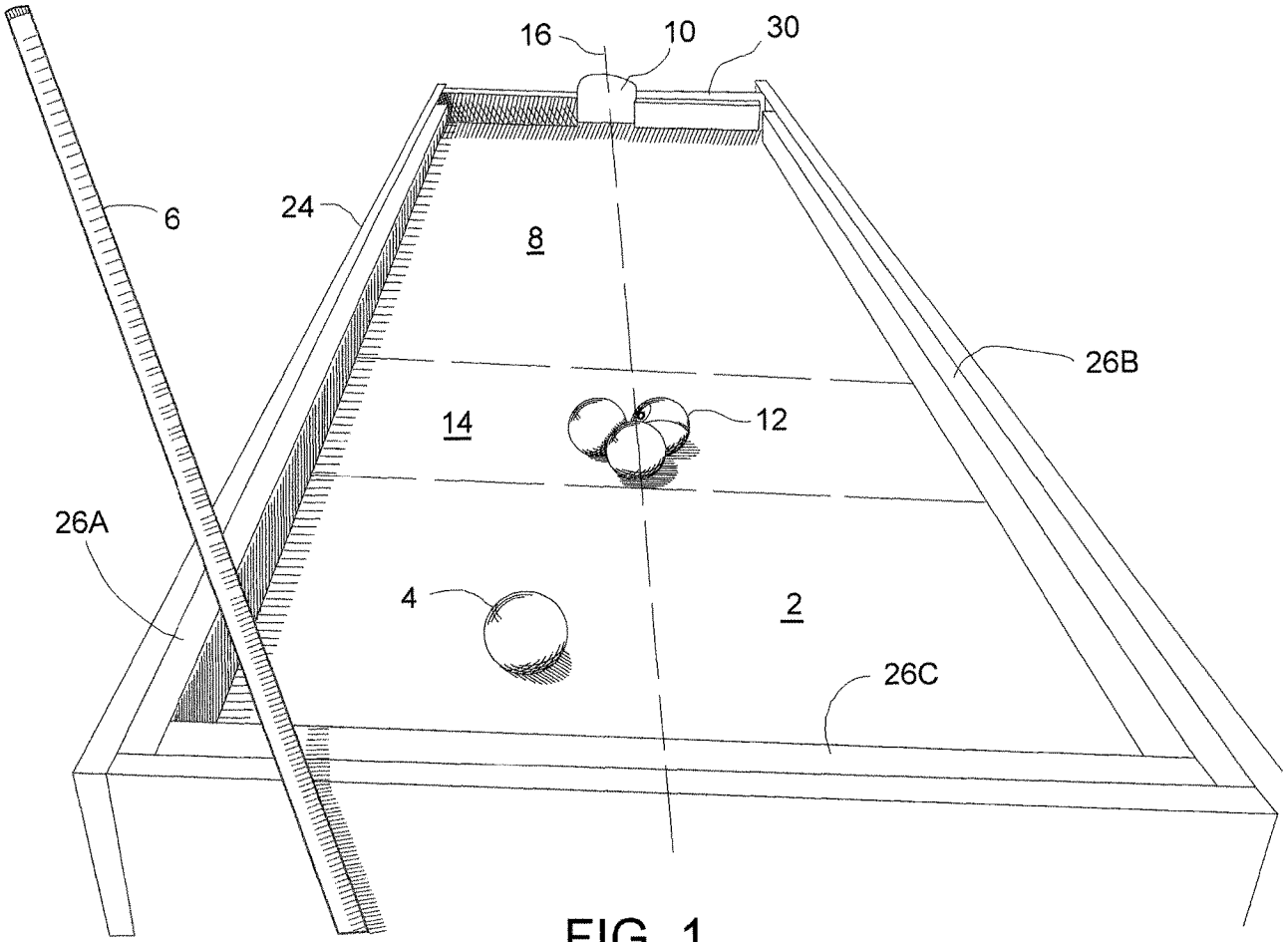
FIG. 1 is a perspective top side view from a cue end of an embodiment of this invention.
Figure 5:
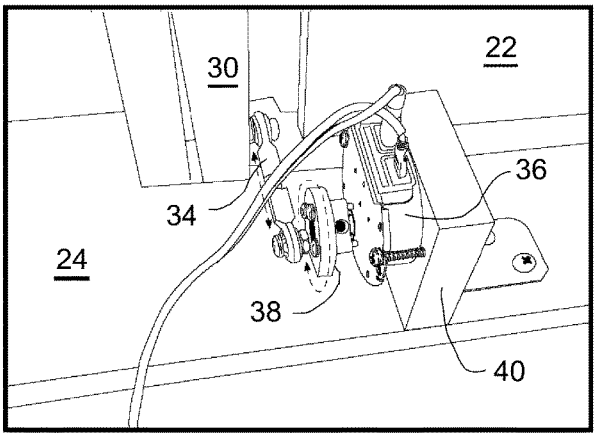
FIG. 5 is a detailed perspective view of an embodiment of a drive mechanism disposed on the underside of this invention.
Figure 2:
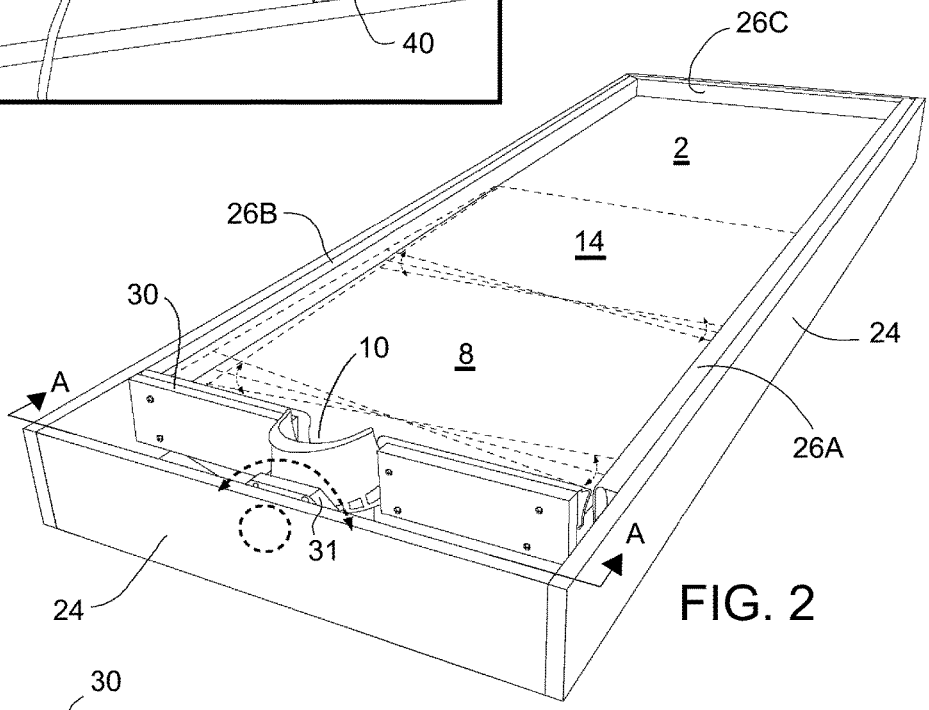
FIG. 2 is a perspective top side view from an object end of an embodiment of this invention.
Figure 3:
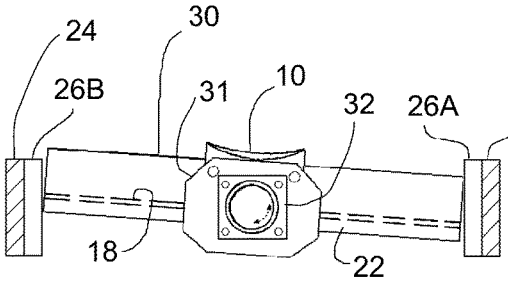
FIG. 3 is a cross-sectional view taken along line A-A.
Figure 4:
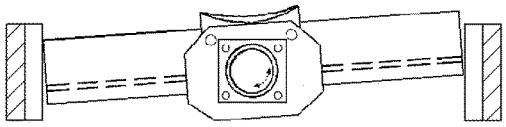
FIG. 4 is a cross-sectional view taken along line A-A.
Figure 6:
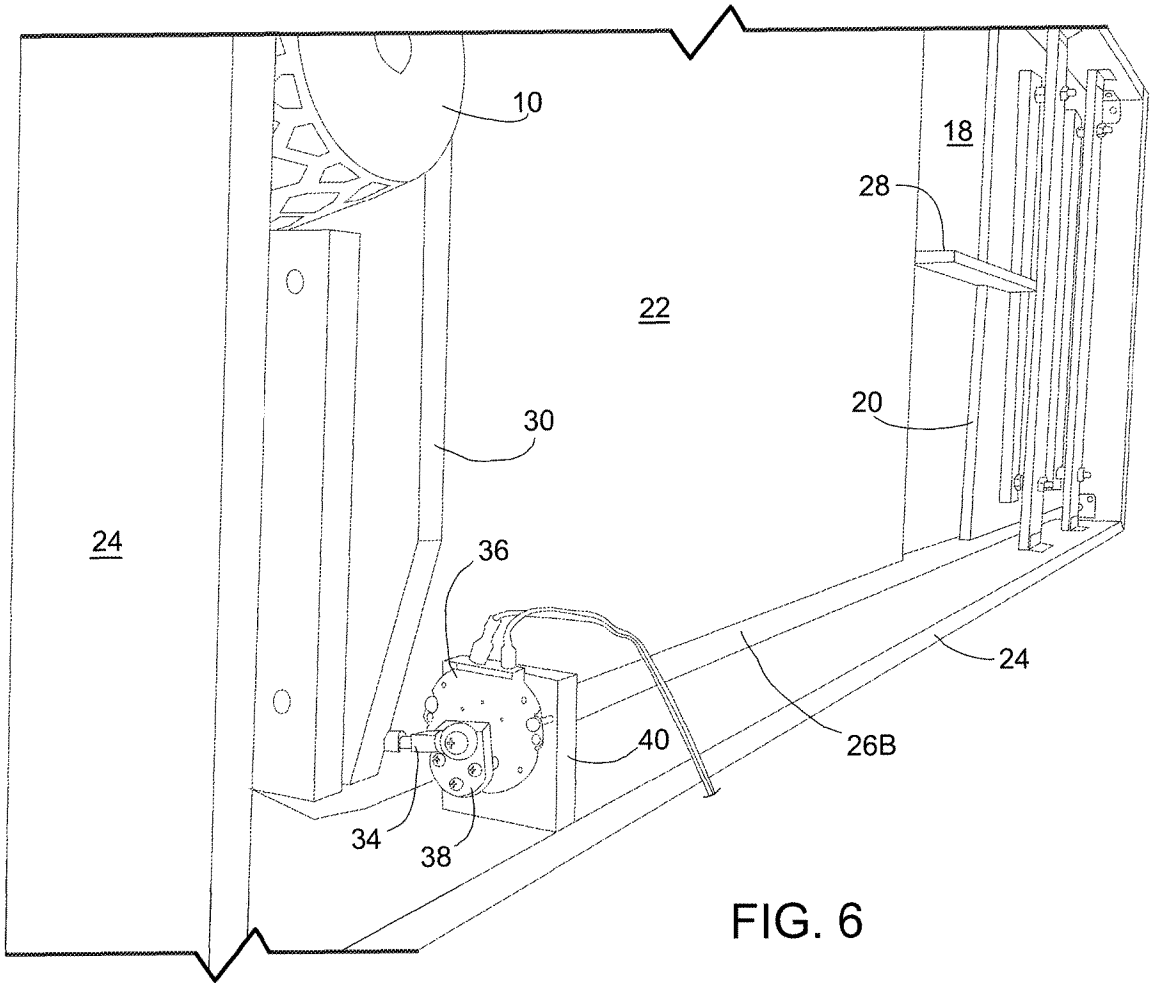
FIG. 6 is a partial perspective view from an object end illustrating the underside of an embodiment of this invention.
Figure 7:
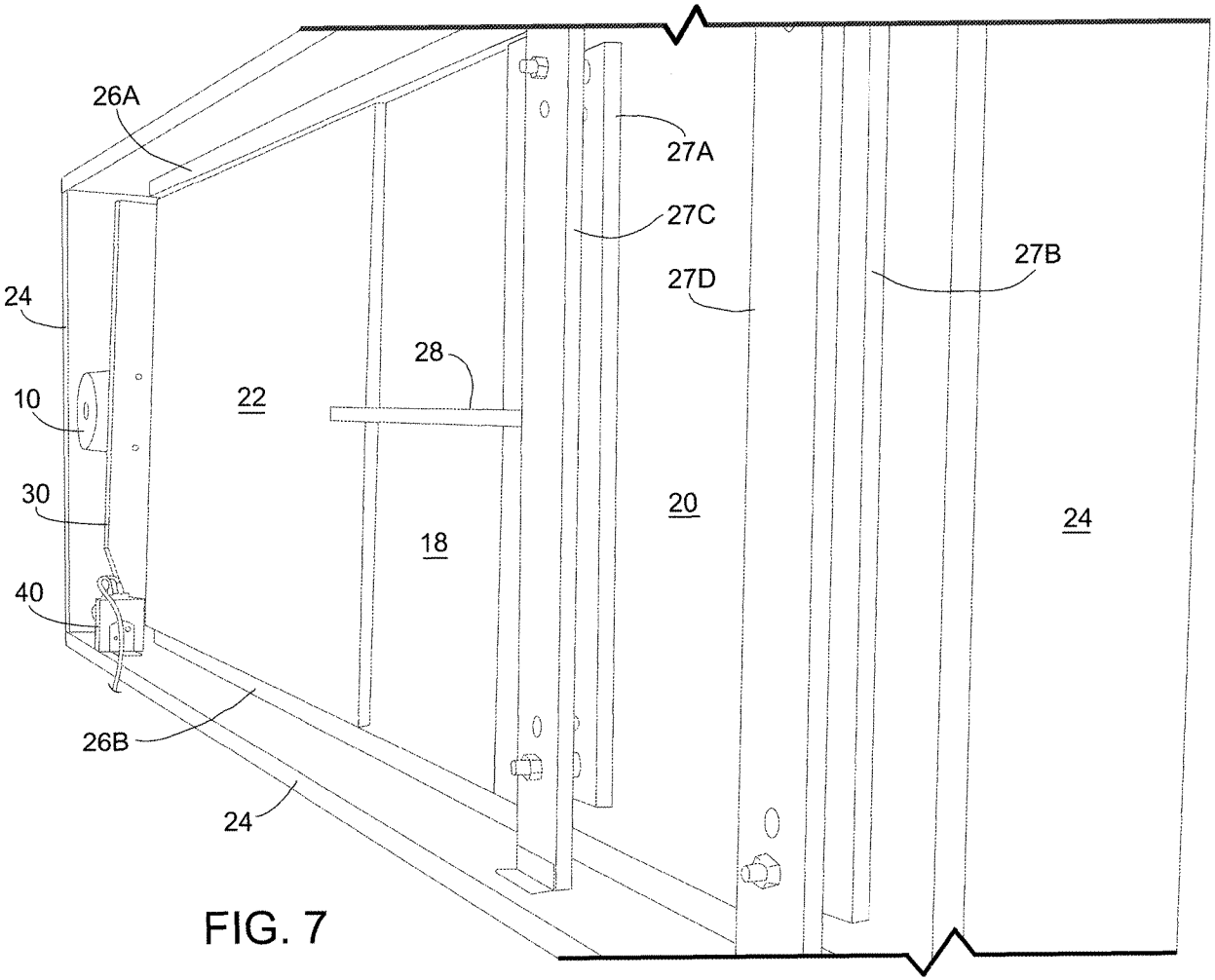
FIG. 7 is a partial perspective view from a cue end illustrating the underside of an embodiment of this invention.

Preferably the playing surface is rectangular and has three distinct sections: a cue section 2 from which, in a preferred version of a cue game, a cue ball 4 is propelled by a cue stick 6; an object section 8 that includes at least one ball pocket 10 for receiving object balls 12 struck by the cue ball or another object ball set in motion directly or indirectly by a propelled cue ball; and a mid section 14 intermediate the other two sections. The ball pocket or pockets are preferably disposed at an end of the object section remote from the cue section.

Preferably the playing surface has a rectangular planar top layer of material having a surface hard enough for a cue game but twistable about its long axis 16, the twist axis. One embodiment includes a rectangular top layer 18 of five millimeter plywood that provides a sufficiently hard surface for a cue game but is twistable enough about its long axis 16 for purposes of this invention. This plywood top layer provides a seamless, that is, smooth and continuous surface to a rolling ball even while being twisted and tilted according to this invention. The top layer is made rigid throughout its cue section by a correspondingly sized stiffener 20 affixed to the underside of the cue section of the top layer. The top layer is likewise made rigid throughout its object section by a correspondingly sized stiffener 22 affixed to the underside of the object section of the top layer. In the plywood embodiment both stiffeners comprise suitably sized rectangular pieces of half inch plywood adhesively affixed to the top layer. The stiffeners keep the cue and object sections planar and confine the twisting to the mid section 14. In lighter weight embodiments the stiffeners for the cue and object sections can be made using strata of stiff foam sandwiched between the top layer and respective bottom layers of plastic or plywood. Alternately ribs on the undersides of the cue and object sections can also be used to stiffen them without adding much weight.

Preferably the playing surface is supported by a rectangular vertical frame 24 which in turn is supported by legs (not shown). Attached to the inside of the frame are side rails, 26A and 26B, and cue section end rail 26C, the rails preferably being cushioned for bank shots. Along the cue section's outer edges, the cue section 2 is affixed to the frame by crossbars 27A-27D to keep the cue section level and steady. The lateral edges of the mid section 14 are closely adjacent to the side rails but not affixed to the frame; the mid section is supported along its twist axis by a cantilever beam 28 affixed to and extending from the cue section. Cantilevering the mid section supports the mid section while allowing it to twistingly flex according to this invention. A cushioned cross-rail 30 is affixed to the object section end of the playing surface. In the preferred embodiment illustrated herein, the object section end of the playing surface also includes the ball pocket 10 disposed in a central gap defined by the cross-rail 30. The cross-rail and pocket are supported by a plate 31 affixed to one side of a swivel plate bearing 32, the other side of the bearing being affixed to the frame. The bearing 32 effectively connects the object section end of the playing surface to the frame for support while allowing the object section to freely rotate relative to the frame and consequently relative to the cue section of the playing surface. Alternatively this invention can include multiple pockets disposed as desired.

Affixed to the frame 24 and linked to the object section cross-rail 30 is a drive mechanism for tilting, from time to time, the object section laterally about the long axis relative to the cue section. Preferably the drive mechanism operates to periodically and symmetrically tilt the object section laterally to one side and then to the opposite side about the long axis, the extent of the tilting being over an angular range. The period of the symmetrical tilting is preferably three to six Hertz but can be set lower to make sinking balls easier or higher to make sinking balls more challenging. Alternatively the period can be user adjustable. In the preferred embodiment the angular range of object section tilting is a function of the drive mechanism linkage and is adjustable.

In the embodiment illustrated herein the drive mechanism comprises a synchronous AC motor 36 affixed to a shoulder 40 projecting from the side rail 26B proximate the object end of the table, a disk 38 coaxially affixed to a rotor shaft of the motor, and an arm 34, one end of the arm being rotatingly connected eccentrically to the disk and the other end of the arm being rotatingly connected to the cross-rail 30 proximate one end of the cross-rail. The arm 34 and disk 38 cooperate to convert the rotational power from the motor to reciprocating lateral tilting of the object end of the table. As illustrated the length of the arm 34 is adjustable although it need not be. Adjusting the length of the arm 34 adjusts the relative amount of tilt left or right. Preferably the length of the arm is adjusted to make the amounts of left and right tilting equal, i.e. symmetrical. Alternatively a player may wish to adjust the length of the arm to make the extents of left and right tilting asymmetrical. The eccentricity of the arm's connection to the disk from the rotational axis of the motor rotor determines the angular range, i.e., degree of tilting. Preferably the angular range of tilting is selected to be within one to thirty five degrees left and right. Adjusting the location of the arm 34 mount on disk 38 relative to the motor rotor's rotational axis adjusts the angular range or amount of tilt in degrees. Increasing the angular range will cause any balls on the object section to roll faster from side to side; decreasing the angular range will correspondingly decrease rolling speed.

The invention claimed is:

1. A table for playing a cue game in which a cue ball is driven by a cue stick to strike an object ball toward a ball pocket, the table comprising: (a) a generally horizontally disposed elongated playing surface comprising: (1) a rigid planar stationary cue section at one end of the playing surface, (2) a rigid planar object section at an opposite end of the playing surface, the object section being rotatable about a long axis of the playing surface relative to the cue section, (3) a mid section integral with and intermediate the cue and object sections, the mid section being twistably flexible about said long axis; (4) wherein the cue, mid and object sections provide a playing surface is-seamless to a rolling ball regardless of the relative dispositions of the cue and object sections; (b) marginal rails for confining the balls atop the playing surface, said marginal rails including a rail opposite the cue section and affixed to the object section; (c) a ball pocket disposed at an opening defined by the rail affixed to the object section; and (d) a drive mechanism for tilting, from time to time, the object section laterally about the long axis relative to the cue section.

2. The table according to claim 1 wherein the drive mechanism periodically tilts the object section laterally to one side and then to the opposite side about the long axis.

3. The table according to claim 2 wherein the period of the tilting is adjustable.

4. The table according to claim 2 wherein the period of the tilting is within a range of one to twelve Hertz.

5. The table according to claim 2 wherein the tilting is symmetrical about the long axis.

6. The table according to claim 5 wherein the tilting is symmetrical over an angular range.

7. The table according to claim 6 wherein the angular range is adjustable.

8. The table according to claim 6 wherein the angular range is one to thirty five degrees.

9. The table according to claim 1 wherein the playing surface further comprises a top layer comprising a planar member twistable about its long axis, a stiffener affixed to the underside of a top layer cue section for rigidifying the cue section, and a stiffener affixed to the underside of a top layer object section for rigidifying the object section.

10. A table for playing a cue game in which, for example, a cue ball is driven by a cue stick to strike an object ball toward a ball pocket, the table comprising:

(a) a generally horizontally disposed elongated playing surface comprising:

(1) a top planar layer of twistably flexible material including a cue section at one end, an object section at an opposite end, and a mid section between the cue and object sections, (2) a stiffener affixed to the underside of the cue section for rigidifying said section, and (3) a stiffener affixed to the underside of the object section for rigidifying said section;

(b) marginal rails for confining the balls atop the playing surface, said marginal rails including a rail opposite the cue section and affixed to the object section;

(c) a ball pocket disposed at an opening defined by the rail affixed to the object section; and (d) a drive mechanism for tilting, from time to time, the object section laterally about the long axis relative to the cue section.

11. The table according to claim 10 wherein the drive mechanism periodically tilts the object section laterally to one side and then to the opposite side about the long axis.

12. The table according to claim 11 wherein the period of the tilting is adjustable.

13. The table according to claim 11 wherein the period of the tilting is within a range of one to twelve Hertz.

14. The table according to claim 11 wherein the tilting is symmetrical about the long axis.

15. The table according to claim 14 wherein the tilting is symmetrical over an angular range.

16. The table according to claim 15 wherein the angular range is adjustable.

17. The table according to claim 15 wherein the angular range is one to thirty five degrees.

* * * * *